United States Patent [19]

Smith, Jr. et al.

[11] Patent Number: 4,874,289

[45] Date of Patent: Oct. 17, 1989

[54] VARIABLE STATOR VANE ASSEMBLY FOR A ROTARY TURBINE ENGINE

[75] Inventors: Leroy H. Smith, Jr.; Donald E. Wilcox, both of Cincinnati, Ohio

[73] Assignee: United States of America as represented by the Secretary of the Air Force, Washington, D.C.

[21] Appl. No.: 202,660

[22] Filed: May 26, 1988

[51] Int. Cl.[4] ..... F04D 29/36

[52] U.S. Cl. ..... 415/150; 415/161

[58] Field of Search ..... 415/148, 149 R, 160–164

[56] References Cited

U.S. PATENT DOCUMENTS

| | | | |
|---|---|---|---|
| 2,316,452 | 4/1943 | Pfenninger | 415/161 X |
| 2,904,307 | 9/1959 | Balje | 415/164 X |
| 3,588,270 | 6/1971 | Boelcs | 415/163 X |
| 3,632,224 | 1/1972 | Wright et al. | 415/161 UX |
| 4,013,377 | 3/1977 | Amos | 415/161 |
| 4,652,208 | 3/1987 | Tameo | 415/162 |

FOREIGN PATENT DOCUMENTS

| | | | |
|---|---|---|---|
| 609768 | 11/1960 | Canada | 415/161 |
| 55-123399 | 9/1980 | Japan | 415/164 |
| 1203853 | 9/1970 | United Kingdom | 415/161 |

*Primary Examiner*—Robert E. Garrett
*Assistant Examiner*—Joseph M. Pitko
*Attorney, Agent, or Firm*—Robert L. Nathans; Donald J. Singer

[57] ABSTRACT

A variable angle vane stator arrangement of relatively simple design is provided enabling widely variable angular stator vane positioning with little aerodynamic loss. This is accomplished by positioning the leading nose portion of each variable second row vane axially ahead of, and adjacent, the trailing edge of an associated fixed vane of a first row of vanes to produce a slot between the adjacent vanes through which air can flow. The axis of rotation of each variable vane is located off of the variable vane itself in a manner to maintain good slot geometry over a wide range of vane stagger angles. The variation of the rear vane stagger angle creates a variation in the direction of the exit air vector, which in turn enhances the performance of the following rotor blade row.

4 Claims, 1 Drawing Sheet

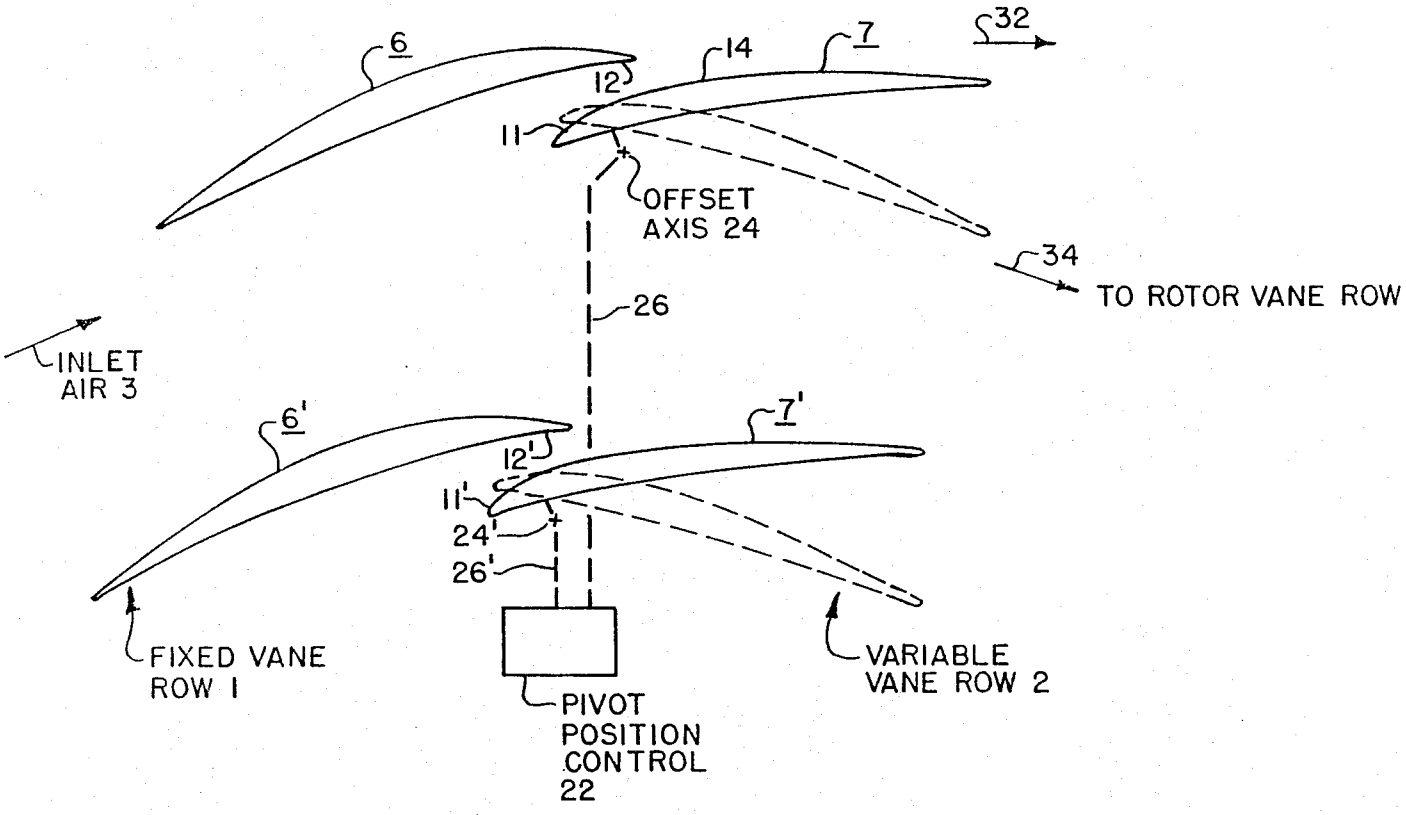
32
7
14
12
11
6
OFFSET
AXIS 24
26
34
TO ROTOR VANE ROW
INLET
AIR 3
7'
12'
11'
6'
24'
26'
VARIABLE
VANE ROW 2
PIVOT
POSITION
CONTROL
22
FIXED VANE
ROW 1

VARIABLE STATOR VANE ASSEMBLY FOR A ROTARY TURBINE ENGINE

STATEMENT OF GOVERNMENT INTEREST

The invention described herein may be manufactured and used by or for the Government for governmental purposes without the payment of any royalty thereon.

BACKGROUND OF THE INVENTION

The present invention relates to the field of turbine engines, and more particularly to variable vane stators for use therein.

In a fan or compressor component of a turbofan or turbojet engine it has been believed to be advantageous to angularly vary some stator vanes to increase the airflow capacity and pressure rise capability of the following rotor blades. This is usually done to improve the matching of vane stages at part-speed conditions in order to increase stall margin. A problem can arise for a conventional variable stator when this is the first such variable vane stage, as its inlet air angle remains nearly constant as the vane's stagger angle is varied, and thus the vane's incidence angle changes with its stagger. If this required stagger adjustment is substantial, the change in incidence will cause the vane to become stalled or choked, which can result in high aerodynamic losses in either case, and possibly may make the stagger adjustment less effective by reducing the turning capability of the vane.

Tameo in U.S. Pat. No. 4,652,208, teaches two axially adjacent rows of variable stator vanes for use in a gas turbine engine, to provide increased airflow. However, the provision of two rows of variable vanes rather than one increases the complexity of the engine, particularly since each row requires variable vane positioning control devices such as those described in the Tameo patent. Thus the suggested use of a fixed row of vanes (see Col. 1 of Tameo) would be more desirable from a design standpoint. However, if a row of variable vanes of Tameo were positioned adjacent a row of fixed inlet vanes, and if the angular positions of the variable vanes were varied substantially, the widths of the air passage slots between the variable vanes of Tameo would vary widely, to produce poor slot geometry, with accompanying aerodynamic losses.

SUMMARY OF THE INVENTION

It is thus a principal object of the present invention to provide a variable vane stator arrangement of relatively simple design and yet enables widely variable stator vane positioning with little aerodynamic loss. This is accomplished by positioning the leading nose portion of each variable second row airfoil or vane axially ahead of, and adjacent the trailing edge of an associated fixed vane of the first row, to produce a slot between the adjacent vanes through which air can flow. The center of rotation of each variable vane is located off of the vane itself in such a way as to maintain a good slot geometry over a wide range of vane stagger angles. The variation of the rear vane stagger angle creates a variation in the direction of the exit air vector, which in turn controls the performance of the following rotor blade row.

BRIEF DESCRIPTION OF THE DRAWINGS

Other objects features and advantages of the present invention will become apparent upon study of the following detailed description taken in conjunction with the sole FIGURE illustrating a preferred embodiment of the invention.

DETAILED DESCRIPTION OF THE PREFERRED EMBODIMENT

Referring now to the sole FIGURE, a preliminary upstream stator vane assembly comprises a first circumferential fixed vane row 1 having vanes 6 and 6' positioned substantially parallel to the inlet air 3, represented by the arrow at the left hand portion of the FIGURE. Circumferential variable vane stator row 2 is positioned downstream of the fixed vane row 1 and comprises a substantial plurality of vanes or airfoils 7 and 7'. The vanes 7 and 7' are angularly positioned so as to provide for a variation in the direction of the air exiting from the trailing edges of the vanes of row 2 to optimize the performance of the rotor vane row which is of a conventional variety. Each vane or airfoil illustrated in the figure has an upper suction surface and a lower pressure surface as is conventional in the art. Nose portions 11 and 11' of the vanes in the variable vane row 2 are positioned axially ahead of, and adjacent, the trailing edge portions 12 and 12' of an associated non-movable vane to form an air passage gap between nose portion 11 and trailing edge portion 12 as illustrated. A pivot position control device 22, forming no part of the present invention, enables each variable vane 7 to be pivoted about offset axes 24 and 24', to thereby control the angle of the air exiting the variable vane row 2 and being directed at the rotor vane row. Such a pivot position control device 22 may, for example, take the form of the device disclosed in FIGS. 2 and 5 of U.S. Pat. No. 2,904,307 issued to Balje et al. Actuation of rod 41 in FIG. 2 causes the rotation of drive ring 37 to in turn rotate rods 18 which are coupled to movable blades 21 via collars 19 and 20 which provide an offset coupling. See also U.S. Pat. 3,632,224 issued to Wright. In the position shown by the solid lines, the vanes would cause the exit air to flow in a direction indicated by arrow 32. If it is desirable for proper matching, to change the direction of the exit air to, for example, the direction indicated by arrow 34, the pivot position control device 22 causes the vanes of the variable vane row 2 to be rotated about offset axes 24 and 24', to assume the positions illustrated by the dotted lines in the FIGURE.

It is an important aspect of the present invention that the pivot axes of each variable vane at 24 and 24' be displaced away from, and in a non-intersecting relationship with respect to each movable vane. Thus offset axis 24, which emerges from the plane of the paper in a direction perpendicular thereto, is displaced away from, or offset with respect to, vane 7, so that upon the rotation of the variable vane about axis 24, the gap formed between the trailing edge portion 12 of fixed vane 6 and nose portion 11 of variable vane 7 will be maintained substantially constant in width, to produce low aerodynamic loss.

It should now be appreciated that this invention enables a great variation in the angle of incidence of the air applied to the conventional rotor stage positioned to the right of variable row 2, without loss of substantial pressure, and without the production of substantial turbulence to reduce aerodynamic efficiencies. As is known to workers in the art, the shape of the vanes or airfoils must be properly selected to produce a smooth flow and an appropriate change in direction of the air passing through the gaps in adjacent vanes. Good slot geometry is maintained with the above described embodiment. Should the teachings of the Tameo patent by followed, axis 24 and 24' would be centrally located within the vanes, and the resulting gap would vary greatly with changes in the angular position of the vanes. A compressor having a diameter of about 25 to 30 inches was built and tested at Wright Patterson AFB employing the present invention. While the size of the components are not believed to be particularly critical, the proportions between the vane cross sections illustrated in a sole FIGURE are believed to be important. In the above described design, the lower velocity of air at the nose portions 11 and 11' of the vanes of row 2 enable wide variation in the angle of incidence of the air exiting from row 2 without substantial aerodynamic losses. Other variations may be made to the aforesaid apparatus within the scope of the present invention, which is defined by the terms of the following claims and art recognized equivalents thereof.

We claim:

1. A preliminary upstream stator vane assembly positioned between an inlet portion of a rotary gas turbine engine and a rotor row thereof, comprising:

(a) a first circumferential row of non-movable leading guide vanes and a second circumferential row of movable trailing guide vanes;

(b) means for positioning the leading nose portion of each movable vane substantially axially ahead of, and adjacent, the trailing edge portion of an associated non-movable vane to form air passage slots; and (c) vane angle control means for pivoting each movable vane about a pivot axis displaced away from and in a non-intersecting relationship with respect to said movable vane and wherein each pivot axis of each movable vane is located to maintain widths of said slots substantially constant as said movable vanes are pivoted.

2. The stator assembly of claim 1 wherein said first and second rows of guide vanes comprise airfoils, each having opposed suction surfaces and pressure surfaces, the suction surfaces of leading portions of said movable vanes being positioned adjacent the pressure surfaces of said non-movable vanes.

3. The stator assembly of claim 2 wherein said non-movable vanes are substantially aligned with respect to the direction of inlet air passing therethrough.

4. The stator assembly of claim 1 wherein said non-movable vanes are substantially aligned with respect to the direction of inlet air passing therethrough.

* * * * *